United States Patent [19]

Aronson

[11] Patent Number: 4,945,447

[45] **Date of Patent: * Jul. 31, 1990**

[54] ELECTROSTATIC GROUNDING SYSTEM FOR WORK SURFACES

[76] Inventor: Harold K. Aronson, 10615 Daines Dr., Temple City, Calif. 91780

[ * ] Notice: The portion of the term of this patent subsequent to Jan. 31, 2006 has been disclaimed.

[21] Appl. No.: 304,169

[22] Filed: Jan. 31, 1989

Related U.S. Application Data

[60] Division of Ser. No. 891,206, Jul. 28, 1987, Pat. No. 4,802,056, which is a continuation-in-part of Ser. No. 844,708, Mar. 27, 1986, abandoned.

[51] Int. Cl.[5] ..... H05F 3/02

[52] U.S. Cl. ..... 361/212; 361/212

[58] Field of Search ..... 361/212, 215, 217, 218, 361/220; 174/51, 52.1; 439/13, 14, 23

[56] References Cited

U.S. PATENT DOCUMENTS

| | | | |
|---|---|---|---|
| 4,373,175 | 2/1983 | Mykkanen | 361/220 |
| 4,580,188 | 4/1986 | Brown et al. | 361/212 |
| 4,602,310 | 7/1986 | Fenster | 361/212 |
| 4,649,374 | 3/1987 | Haigard | 361/212 |
| 4,722,025 | 1/1988 | Robinson | 361/212 |
| 4,754,364 | 6/1988 | Speef et al. | 361/212 |
| 4,802,056 | 1/1989 | Aronson | 361/212 |

*Primary Examiner*—A. D. Pellinen
*Assistant Examiner*—Jeffrey A. Gaffin
*Attorney, Agent, or Firm*—Christie, Parker & Hale

[57] ABSTRACT

An electrostatic grounding system for work surfaces having a covering such as a laminate covering, which includes a conductive layer to carry static charges. The system includes a grounded conductive plug in the work surface. To maximize the area of contact between the plug and conductive layer, the plug has a head with a tapered circumference which may also include ridges to further maximize the area of contact. Also set forth is the plug and a device for grounding a person through the work surface and plug.

5 Claims, 5 Drawing Sheets

ELECTROSTATIC GROUNDING SYSTEM FOR WORK SURFACES

CROSS-REFERENCE TO RELATED APPLICATIONS

This is a division of application Serial No. 06/891,206 filed Jul. 28, 1987, now U.S. Pat. No. 4,802,056, which is a continuation-in-part of Ser. No. 06/844,708 filed March 27, 1986, now abandoned.

FIELD OF THE INVENTION

This invention relates to work areas or stations where static electrical discharge presents a danger of shock or equipment damage or impairment. More particularly, this invention relates to grounded work stations adapted for assembly, support or inspection of electrical components.

BACKGROUND OF THE INVENTION

In various applications, static electrical discharge can present a hazard to personnel and equipment. For example, where sensitive electrical components are being handled, assembled or tested, a static discharge could degrade or irreparably damage the components.

In an effort to prevent the buildup of static electricity, it has been known to provide work stations wherein the work surfaces, personnel and surroundings are grounded. With reference to work stations, -conductive laminates have been developed for use as table and bench tops. At a suitable location, a grounding terminal is screwed into the surface to penetrate the laminate to be in intimate contact with the conductive layer(s) of the laminate.

A problem with this prior art work stations is that the surface area of contact between the grounding terminal and conductive layer is relatively small as defined by the circumference of the terminal multiplied by the thickness of the conductive layer which is on the order of ten thousandths of an inch. During assembly or handling, or as a result of corrosion or other chemical degradation, the area of contact between the conductive layer and terminal may be further diminished affecting the overall ability of the work station to effectively and quickly ground static charges. It is important to note that according to many specifications, static charge must be dissipated at a rather fast rate. The small area of contact between the grounding terminal and the susceptibility to reduction of that area during assembly, handling or over time may affect the ability of the work surface to meet the specifications.

In conjunction with grounding the work surface, it is often required that personnel operating at or near the work surface likewise be grounded.

SUMMARY OF THE INVENTION

To overcome the deficiencies noted above, a grounded work station is set forth which provides for a maximum surface contact between the grounding terminal or plug and the conductive layer(s) of the laminate for the work station. Also set forth are means for grounding personnel through the work surface.

Toward this end, a grounded work station is set forth which includes a work surface having a laminate covering with a static electricity dissipating surface overlaying a conductive inner layer. The static electricity dissipating outer layer may be defined by a polyurethane or resin impregnated fabric as is known in the art. The conductive inner layer may be impregnated with carbon particles thusly rendering it conductive. Means are provided for grounding the conductive inner layer, the grounding means including a conductive plug disposed in the work surface, the plug having a head with a tapered circumference, adapted to be positioned to make intimate contact with the conductive inner layer. Means ground the plug and hence the conductive inner layer and work surface.

By virtue of providing the plug with a tapered head, the surface area of intimate contact between the plug and conductive inner layer is maximized. Preferably, the circumference rim is tapered at a 45 degree angle maximizing the area of contact.

To further enhance the area of contact between the grounding plug and conductive inner layer, the rim of the head may include a plurality of protuberances preferably configured as ridges which penetrate into the conductive inner layer to further increase the surface area of intimate contact between the grounding plug and conductive inner layer.

To still further enhance the conductive contact between the inner layer and grounding plug, conductive paint of a type known in the art may be applied between the plug and laminate.

As an additional feature to the present invention, means are provided for grounding personnel at the work surface. These means include a fixture mounted to the work station, the fixture in electrical conductive relationship with the grounding plug. This communication may be facilitated by mounting the fixture through the laminate, the fixture being in an intimate conductive relationship with the conductive layer of the laminate which conducts any built up static electrical charges to the grounding plug for dissipation thereof. In work stations where the conductive laminate is provided only on one surface remote from fixture, a conductive foil may be provided to extend between the fixture and the plug for grounding of the individual. The fixture has a receptacle to receive a jack connecting a wire leading from a wristband worn by the personnel to the fixture. Any static electrical charges carried by the individual are conducted from the wristband through the wire and jack to the fixture for grounding thereof.

In another embodiment the fixture is embodied as a swivel secured to the grounding plug. The swivel has at least one receptacle to receive the personnel grounding jack. As the person moves, the swivel pivots to prevent damage to the jack and the wire and to provide for rlease of the jack when the wire is pulled.

BRIEF DESCRIPTION OF THE DRAWINGS

These and other features and advantages will become better appreciated when the same becomes better understood with reference to the following specification, claims and drawings wherein:

DETAILED DESCRIPTION

Figure 1:
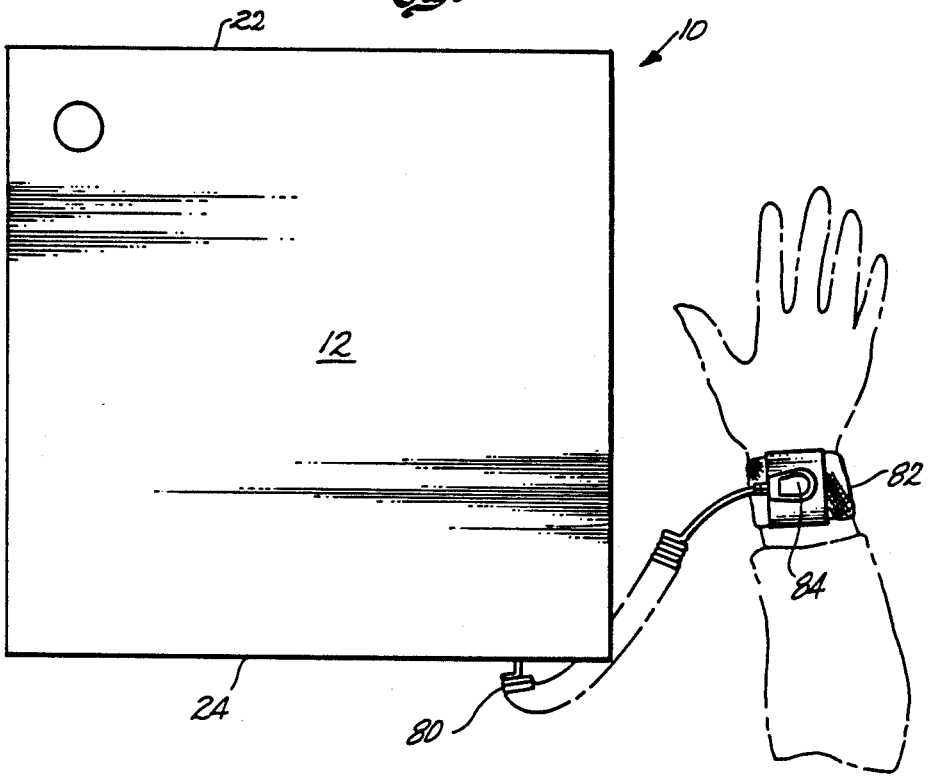
FIG. 1 is a top plan view of a work station according to the present invention.

With reference to FIGS. 1–4, an embodiment of a work station 10 according to the present invention is shown. The work station 10 in a manner described below is grounded and is well suited to support sensitive electrical components during assembly, testing or use. Static electricity presents a hazard of degrading or damaging the sensitive electrical components and hence, by providing the grounded work station 10, such components are protected from built up static electrical charges.

The work station 10 includes a work surface 12 which may be a bench, table top, stand or the like, when oriented in a horizontal attitude or may be a vertical panel supporting electrical components. The description hereinafter will be directed toward use of the work station 10 when the work surface 12 is arranged horizontally as a workbench. The work surface 12 includes a fiberboard core 14 upon which is disposed a laminate covering 16. As shown in the drawings, the core 14 and laminate covering 16 define for the work surface 12, a top 18, bottom 20 transverse rear edge 22 and a 180 ° rounded front edge 24. At the work station 10, the electrical components are disposed on the top 16 for assembly or testing thereof, for example.

The laminate covering 16 is substantially continuous extending from a first terminal edge 26 at the work surface rear edge 22, over the top 16, around the front edge 24, the covering 16 terminating at a second terminal edge 27 disposed rearwardly of the front edge 24 a distance suitable for the purposes hereinafter set forth. In that the core 14 has a 180 ° rounded front edge, the covering 16 is adapted to continuously follow the curvature thereof.

Figure 3:
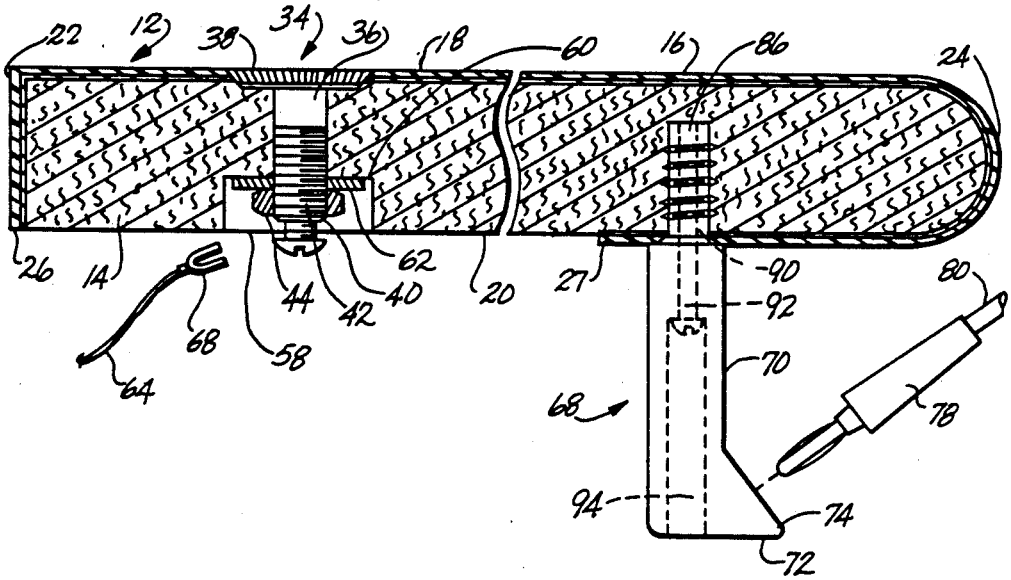
FIG. 3 is a side section view through the work station.
Figure 4:
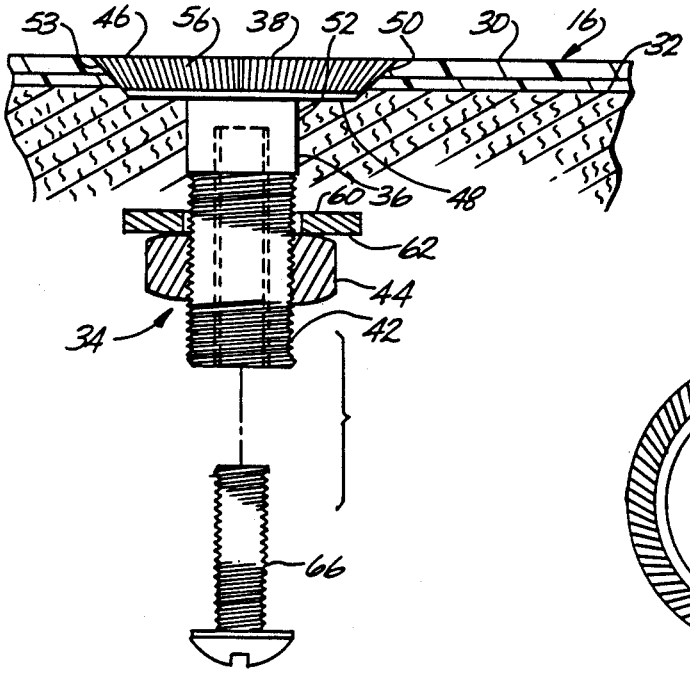
FIG. 4 is an enlarged section view through the work station illustrating the grounding plug according to the present invention.

With specific reference to FIGS. 3 and 4, the laminate covering 16 includes an upper layer 30 of, for example, polyurethane or resin impregnated fabric which satisfactorily defines a static electricity dissipating, rugged top 18 for the work surface 12. The upper layer 30 is disposed over and is in intimate contact over the entire extent thereof with an inner conductive layer 32 having a thickness, for example, of 0.010 inches. Various materials can be employed to define the conductive layer 32 such as by impregnating a resin or polyurethane substance with carbon particles or perhaps a conductive fabric or mesh impregnated with polyurethane or resin. Various manufacturers make and sell such laminates identified as: Durestat (a trademark of VPI in Sheboygan, Wisc.), Micastat (a trademark of Charles Water, Inc. West Newton, Mass.), antistatic laminate manufactured by the Formica Corporation and others of equal quality.

To fashion the work surface 12, the laminate 16 is affixed to the core 14 to smoothly and continuously cover the rear edge 22, top 18, front edge 24 and to extend partially along the bottom 20 as illustrated in FIG. 3. The method for affixing the laminate 16 to the core is as per manufacturers' suggested method typically including the use of an adhesive. Suffice it to say the laminate 16 and the method for securing it to the core 14 are known.

To ground the work surface 12, a conductive grounding plug 34 is inserted into the work surface 12. The plug may be brass, stainless steel or the like. Copper can also be used; however, it is subject to oxidation and chemical attack. The plug 34 as shown in FIGS. 3 and 4, includes a cylindrical shank 36 having at one end a head 38 and at the other end a plug end 40. The shank 36 has an external thread 42 extending over a portion thereof to receive a nut 44 for affixing the plug 34 to the work surface 12.

Figure 5:
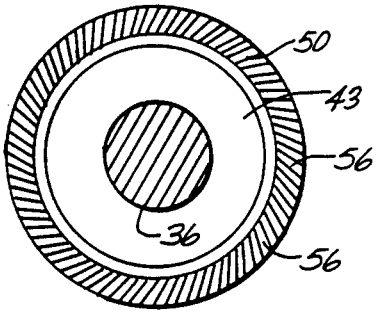
FIG. 5 is a bottom section view of the grounding plug according to the present invention illustrating various features thereof.

With specific reference to FIGS. 4 and 5, the head 38 is fashioned as a flat disc arranged to coaxially with the shank 36 and having a circular end face 46 presented at the top 18 of the work surface 12, the underside of the head 38 defining a lesser diameter shoulder 48. Defined between the face 46 and shoulder 48 is a conical, inwardly tapering rim 50 for the head 38. Preferably, for reasons hereinafter set forth, the rim 50 tapers at an angle of 45 degrees with respect to the axis of the plug 34. Of course, it is to be understood that other angles could be used and the plug could function satisfactorily; however, it will be appreciated that the 45 degree angle is preferred.

To receive the plug 34, the work surface 12 is provided with a bore 52 having a diameter to closely pass the shank 36. At the top 18, a conical countersink 53 is provided to closely accommodate the head 38 in a manner such that when the plug 34 is secured to the work surface 12, the face 46 lies substantially flush with the upper layer 30 at the top 18. In this position, as shown in FIG. 4, the rim 50 is in an intimate electrically conductive relationship with the conductive layer 32 over the circumference of the rim 50. Since the rim 50 and countersink 53 including the conductive layer 32 are tapered at a 45 degree angle, the surface contact between the conductive layer 32 and plug 34 is maximized. Unlike prior grounding terminals or the like, which pass orthogonally through the conductive layer 32, the enlarged head with tapered rim significantly increases the intimate surface contact between the plug and conductive layer 32.

To further enhance the intimate conductive relationship between the plug 34 and conductive layer 32, the rim 50 may be provided with a plurality of ridges, protuberances or serrations 56 disposed to penetrate the conductive layer 32 when the plug 34 is affixed to the work station 12. While the serrations 56 may be arranged radially, to enhance surface contact they are preferably, as shown in FIG. 5, disposed to radially spiral outwardly from the shoulder 48 to the face 46. As can be appreciated, the enlarged head 38, tapered rim 40, and spiralling serrations 56 maximize the electrical conductive relationship between the conductive layer 32 which follows the contour of the rim 50 of the plug 34. Over a simple penetration by a cylindrical terminal, the tapered arrangement increases the area of contact by about fifty percent.

To attach the plug 34 to the work station 12, the bottom 20 may be provided with a cylindrical recess 58 arranged coaxially with bore 52, the recess 58 terminating at an annular stop 60. During assembly, the shank 36 is passed through the bore 52 to position the head 38 at the countersink 54. The nut 44 is received by the thread 42 and is rotated along the shank 36 to trap a conductive washer 62 against the stop 60. Continuing to rotate the nut draws the head 38 downwardly such that the rim 50 is drawn into the intimate electrical conductive relationship with the conductive layer 32. The serrations 56 penetrate into the conductive layer 32 to maximize the surface contact between the conductive layer 32 and conductive plug 34.

To ground the conductive layer 32 and the work station 12, the plug 34 is grounded by a suitable grounding wire 64. This wire may be disposed about the shank 36 or, as shown in FIGS. 3 and 4, may be coupled to the shank 36 by a screw 66 axially received into the plug end 40 to thereby hold a wire clip 68 to the conductive plug 34.

With the work surface 12 grounded, electrostatic charges encountering the work surface 12 will quickly dissipate through the upper layer 30 to be conducted by the conductive layer 32 to the grounded plug 34. By virtue of the maximized surface contact between the grounded plug 34 and conductive layer 32, complete and rapid dissipation of the charge is assured.

Figure 2:
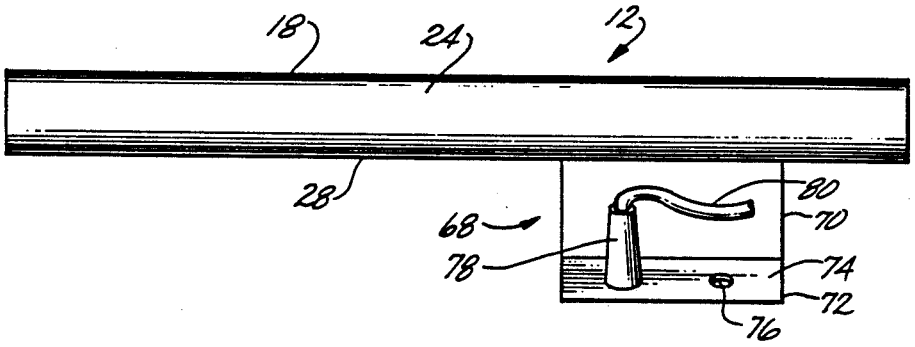
FIG. 2 is a front view of the work station according to the present invention with portions of the personnel grounding wire removed for clarity.

It is sometimes required or necessary that personnel working at the work surface 12 also be grounded. For this purpose, the work station 10 includes a conductive fixture 68 secured to the underside 20 of the work surface 12 and in conductive communication with the conductive layer 32. As shown in FIGS. 2 and 3, the fixture 68 includes a body 70 which depends from the underside 20 to terminate at a foot 72. The foot 72 presents an angled surface 74 including at least one and preferably several receptacles 76 adapted to receive a jack 78 of known construction. The jack 78 is connected at one end of a grounding cable 80 which extends to a wrist strap 82 encircling the person's wrist. The wrist strap 82 has an electrode 84 making intimate contact with the person's skin to conduct any static electrical charges through the cable 80 to the jack 78 and fixture 68.

To ground the fixture 68, at least one and preferably a pair of threaded conductive mounts 86 are screwed through the covering 16 presented at the underside 20. Each mount has external cutting teeth and an axial threaded bore 90 adapted to receive a conductive mounting screw 92. After the mounts 86 have been inserted into the respective bores and are fixed in the work surface 12, the fixture 68 is attached to the mounts and work surface by the mounting screws 92 which are received through the fixture 68 by appropriate openings 94. Since the mounts 86 are in intimate contact with the conductive layer 32, and with the body 70, static electrical charges from the cable jack 78 are transmitted through the conductive fixture 68 to the conductive layer 32 and, via the conductive layer 32 to the grounded plug 34.

Figure 6:
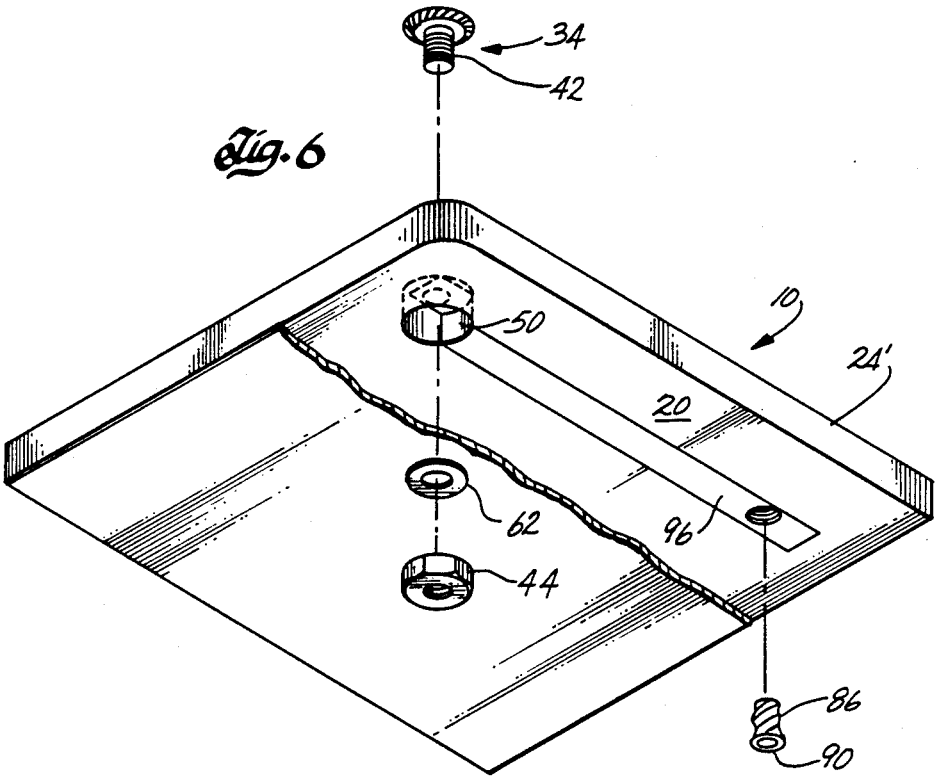
FIG. 6 is a perspective view of the underside of yet another embodiment of the work station according to the present invention.
Figure 7:
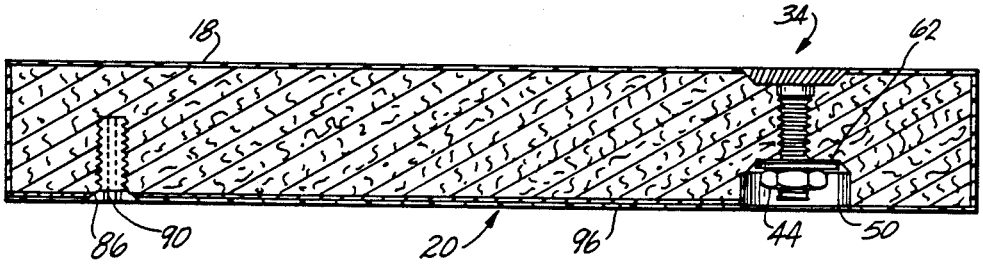
FIG. 7 is a front section view of work station of FIG. 6.

With reference to FIGS. 6 and 7, still another embodiment of the work station 10 is shown. According to this embodiment, the conductive layer 32 is provided only at the top surface 18. The remaining surfaces such as the orthogonal rear edge 22 and front edge 24' and underside are provided with a simple laminate which does not include the conductive layer.

To ground the top 18 for the work surface 12, the grounded plug 34 as described above is provided. To ground the fixture 68, a copper foil or other conductive bus 96 is provided between the laminate at the underside 20 and core 14, the bus 96 extending along the underside 20 near the front edge 24. The mounts 86 are inserted into the underside 20 of the work surface 12 at locations to make intimate contact with the bus 96. Hence, electrostatic charges from a person through the cable jack 78 are conducted by the mounts 86 through the bus 96 to the grounded plug 34. At the recess 58, the bus follows the contour thereof and is presented at the stop 60 for contact with the conductive washer 62 and plug 34 for grounding of the fixture 68.

Figure 8:
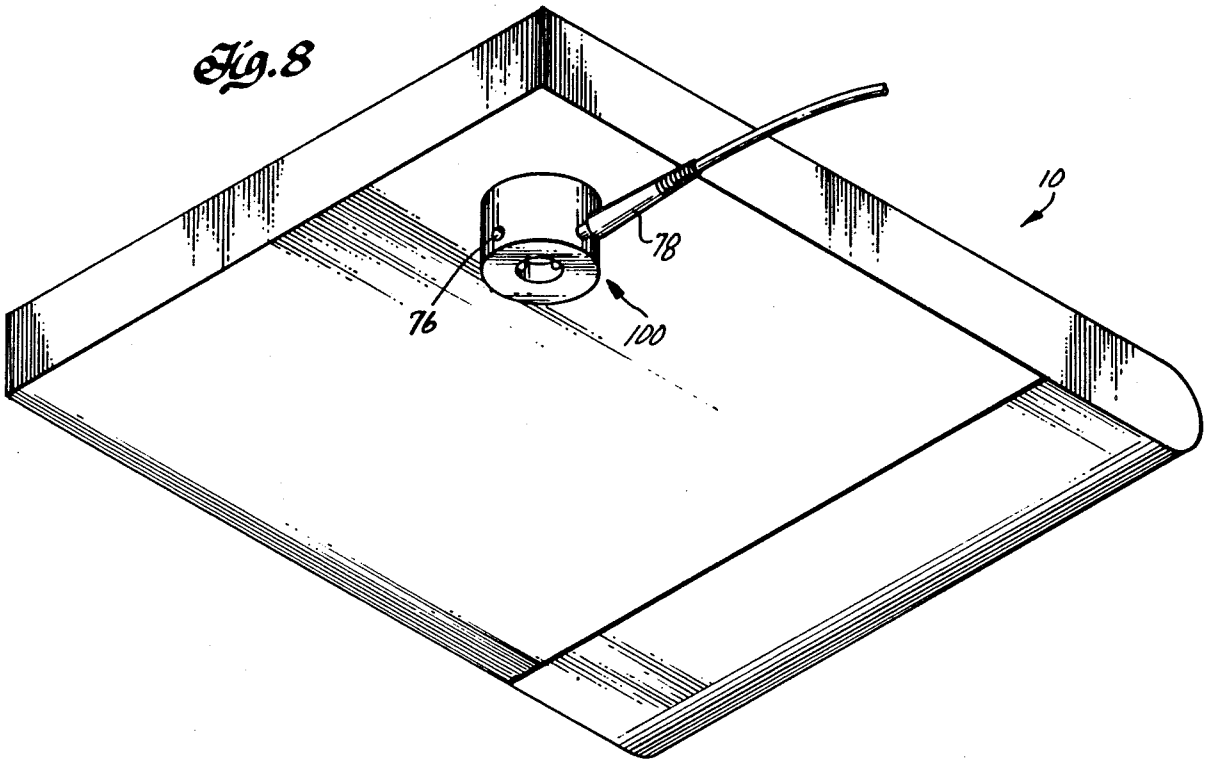
FIG. 8 is a bottom perspective view of a work station including a swivel to receive a personnel grounding jack and FIG. 9 is a perspective, exploded view of the swivel of FIG. 8.
Figure 9:
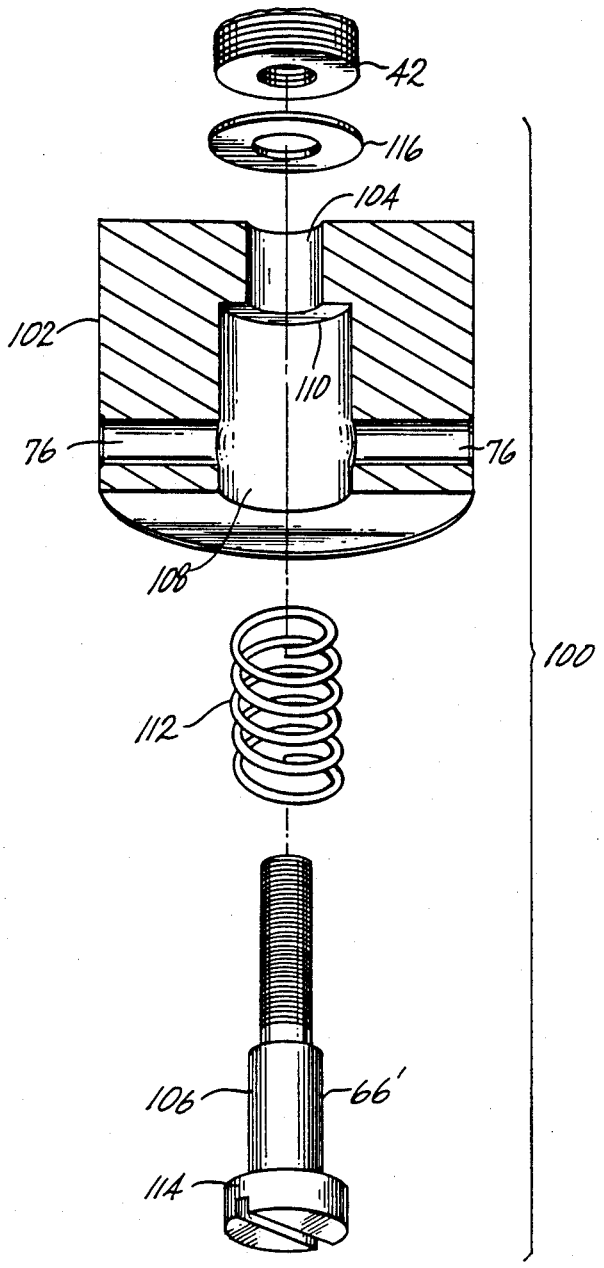

Turning to FIGS. 8 and 9, a further embodiment of the means for grounding personnel is shown. Like components will carry the same reference numeral.

According to this embodiment, the work station 10 includes a conductive swivel 100 having one or several receptacles 76 to receive the jack 78 in the well known, plug-in fashion. The swivel 100 may be secured to a mount of the type described above adapted to secure the conductive fixture to the underside 20 of the work surface 12 or, as shown in FIG. 8, may be secured to the grounding plug 34 and more particularly its shank 36.

The swivel 100 includes a conductive turntable 102 retained in conductive relationship with the plug 34 by a screw 66' which is axially threaded into the shank 42 of the plug 44. To accommodate the screw 66', the turntable 102 has an axial bore 104 adapted to closely pass the shaft 106 for the screw 66'. The axial bore 104 terminates at an axially arranged larger diameter chamber 108 to define an annular seat 110 at the interface of the bore 104 and chamber 108. When secured to the plug shank 42 by the screw 66', a coiled spring 112 is trapped between the seat 110 and the head 114 for the screw 66' thereby biasing the turntable 102 against the plug 34. A washer 116 is disposed between the turntable 102 and the base of the plug shank 42 to provide a bearing surface for axial rotation of the turntable 102 while maintaining conductive contact between the turntable 102 and plug shank 42.

When mounted to the work surface, the swivel 100, and more particularly its turntable 102 is permitted to pivot impeded only by the friction between its components. In response to pulling or jerking of the wire 80, the turntable. 102 rotates about the screw 66'to direct the jack containing a receptacle 76 in the direction at which the wire 80 is being pulled thereby preventing kinking in the wire 80 or damage to the jack 78. Kinking of the wire 80 may result in failure of the wire 80 and thereby the failure to ground the person working at the work station. Similarly, damage to the jack 78 may have the same result. Should the pull on the wire 80 be sufficient, the turntable 102 will rotate in the above described manner to enable the jack 78 to pull from the turntable 102 thereby preventing damage thereto.

While I have shown and described certain embodiments of the present invention, it is to be understood that it is subject to many modifications without departing from the spirit and scope of the appended claims.

What is claimed is:

1. A grounded work station comprising:

a work surface including a laminate covering having an outer layer over an inner conductive layer;

means for grounding said inner layer to ground static electric charges, said grounding means including a conductive plug disposed in said work surface, the plug having a head adapted to be drawn against said covering, the head having a tapered circumference disposed in an intimate electrical conductive relationship with the conductive layer;

means for electrically grounding the plug to thereby ground the work surface;

a fixture attached to the work station, said fixture being connected in an electrically conductive relationship with said conductive layer, the fixture including connecting means to receive a grounding cable.

2. A work station according to claim 1 including means for attaching the grounding cable between said connecting means and a person using the work station to thereby electrically connect said person to ground through the fixture, plug and conductive layer.

3. A work station according to claim 2 wherein the fixture includes a swivel and the connecting means is adapted to receive a connector on the grounding cable, said swivel being rotatable to prevent kinking of the cable and damage to the connector and connecting means.

4. A work station according to claim 3 wherein the swivel is rotatably mounted on and electrically connected to the plug.

5. In a work surface of the type including a core and a laminate covering the core, said laminate having an outer layer over an inner conductive layer, the improvement comprising:

a grounded conductive plug for grounding the conductive layer and work surface, the plug having a head with a tapered circumference, the circumference of the head being in an electrically conductive relationship with the conductive layer; and a rotatable swivel mounted on the plug in electrically conductive relationship threwith, said swivel including a receptacle electrically interconnected to a grounding cable at one end, said cable being adapted to be connected in an electrically conductive relation with a person at the opposite end to ground the person through said plug.

* * * * *